United States Patent [19]

Chaiko

[11] 4,284,379

[45] Aug. 18, 1981

[54] EARTH STRUCTURE STABILIZER

[75] Inventor: Walter M. Chaiko, Titusville, N.J.

[73] Assignee: Ingersoll-Rand Company, Woodcliff Lake, N.J.

[21] Appl. No.: 60,583

[22] Filed: Jul. 25, 1979

[51] Int. Cl.[3] ..... F16B 13/06; E21D 21/00

[52] U.S. Cl. ..... 411/61; 405/259; 411/521

[58] Field of Search ..... 85/85, 8.3, 84, 14, 85/82, 83; 405/259; 52/738, 731, 720; 411/61, 60

[56] References Cited

U.S. PATENT DOCUMENTS

| | | | |
|---|---|---|---|
| 937,039 | 10/1909 | Bauer | 85/74 |
| 1,410,258 | 3/1922 | Kennedy | 85/85 |
| 1,802,270 | 4/1931 | Rawlings | 85/85 |
| 2,931,412 | 4/1960 | Wing | 85/32 R X |
| 3,425,311 | 2/1969 | Levy | 85/8.3 |
| 3,667,341 | 6/1972 | Kaplan | 85/85 X |
| 3,922,867 | 12/1975 | Scott | 85/85 |

FOREIGN PATENT DOCUMENTS

| | | | |
|---|---|---|---|
| 414631 | 10/1932 | United Kingdom | 85/85 |
| 963080 | 7/1964 | United Kingdom | 85/85 |

*Primary Examiner*—Ramon S. Britts

*Attorney, Agent, or Firm*—David W. Tibbott; Bernard J. Murphy

[57] ABSTRACT

According to a preferred embodiment of the invention the stabilizer comprises an elongate, generally annular element for insertion into an undersized bore in a roof or wall of a mine shaft, or tunnel, or the like, for frictionally engaging the bore surface to stabilize the subterranean earth structure in which the bore is formed, in which the element has stiffening ribs disposed lengthwise thereof in order that the stabilizer may be formed of relatively thin material without significant loss of longitudinal strength. The ribs are defined by inwardly-directed channels, formed in the outer surface of the stabilizer, which facilitate circumferential compression of the stabilizer so that the latter can be readily inserted into the undersized, earth structure bore.

9 Claims, 4 Drawing Figures

FIG. 1
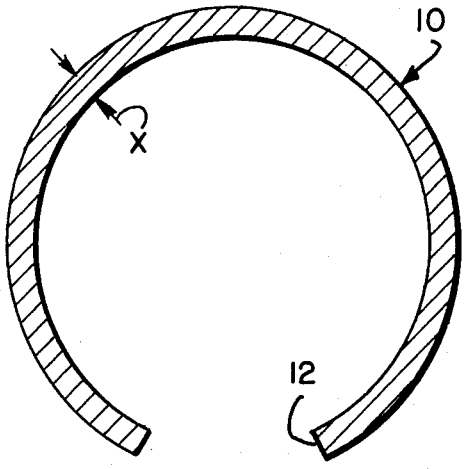
PRIOR ART
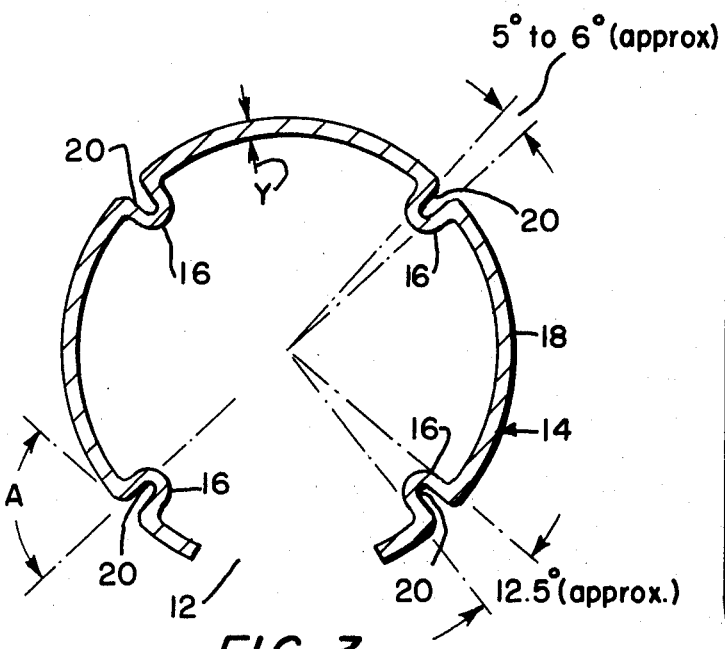
FIG. 3
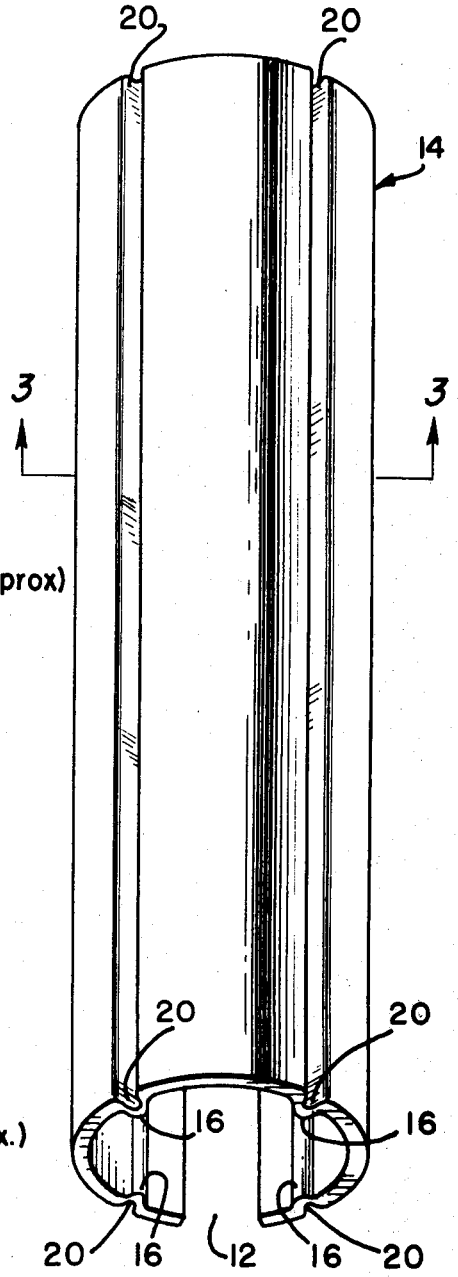
FIG. 2
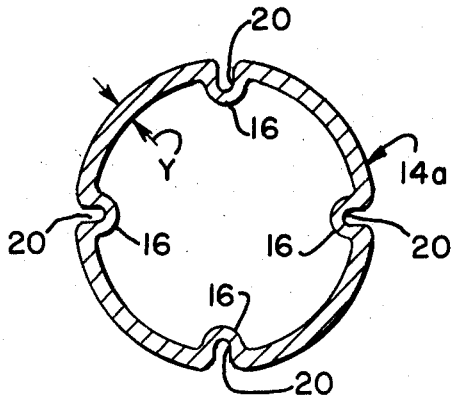
FIG. 4

EARTH STRUCTURE STABILIZER

This invention pertains to earth structure stabilizers—also identified as friction rock stabilizers—and in particular to an improved earth structure stabilizer, formed of relatively thin gauge material which, therefore, accepts a substantial circumferential compression to facilitate insertion thereof into an especially undersized earth structure bore and which, nevertheless, retains an optimum and necessary longitudinal strength.

Friction rock stabilizers, or earth structure stabilizers are, in particular, known in the art by the trade mark "Split Set", the latter being the mark of exemplary friction rock stabilizers marketed by the Split Set Division of Ingersoll-Rand Equipment Corporation, Princeton, N.J. Such stabilizers generally conform to the embodiment thereof depicted in U.S. Pat. No. 3,922, 867, issued on 2 Dec. 1975, to James J. Scott, and since reissued as U.S. Pat. No. Re. 30,256, on 8 Apr. 1980. Typically, the stabilizers are of approximately five feet in length, one and a half inch to one and nine sixteenths inch in outside diameter, and are substantially annular in cross-section. They are circumferentially compressed and forceably inserted into undersized bores (formed in earth structures) and, due to the length thereof, and the insertion forces necessary for their installation, have required a given wall thickness to insure adequate longitudinal strength thereof. The requisite wall thickness, however, defines a practical limit in the circumferentially compressed, i.e., reduced diameter which may be achieved with the stabilizer and, hence, a limit as well as to the smallest diameter earth structure bore into which the stabilizer can be inserted.

It would be a simple matter to form the stabilizer of thinner gauge material, so that it could be circumferentially compressed to smaller diameters. However, such thinner gauge material, of the typical five foot length, would lack the longitudinal strength required to withstand forceable insertion into an undersized bore.

What has been needed is an improved friction rock stabilizer or earth structure stabilizer formed of thinner gauge material, to facilitate compression thereof to smaller diameters, but which, nevertheless, posesses the longitudinal strength of the normal, thicker-gauge-material stabilizer.

It is an object of this invention, therefore, to set forth an improved earth structure stabilizer which meets the aforesaid need.

It is particularly an object of this invention to disclose an improved earth structure stabilizer, for insertion into a bore formed in an earth structure such as a roof or side wall of a mine shaft, or tunnel, or a like subterranean opening, for frictionally stabilizing such earth structure, said stabilizer comprising an elongate element having a generally annular cross-section of a given, free, outside, diameter, and formed of material responsive to circumferential compression to facilitate a diminution of said given diameter to another, compressed, outside diameter, whereby said stabilizer can be inserted into and received by an earth structure bore having a diameter generally approximating said another diameter, to cause said stabilizer to engage the surface of such bore and frictionally anchor therewith, to stabilize the earth structure in which such stabilizer-receiving bore is formed, wherein the improvement comprises stiffener means extending lengthwise of said element, and projecting radially inwardly thereof only, for stiffening said stabilizer elongatedly.

Further objects of this invention, as well as the novel features thereof, will become more apparent by reference to the following description taken in conjunction with the accompanying figures, in which:

FIG. 1 is a cross-sectional view of a prior art earth structure stabilizer generally according to the aforesaid U.S. Pat. No. 3,922,867 and U.S. Pat. No. Re. 30,256;

FIG. 2 is a perspective view of an embodiment of an improved earth structure stabilizer according to the invention;

FIG. 3 is a cross-sectional view taken along section 3—3 of FIG. 2, wherein FIGS. 1 and 3 are of approximately same scale, and FIG. 2 is smaller, approximately two-thirds that scale; and FIG. 4 is a cross-sectional view, in about the scale of FIG. 2, of an alternative embodiment of the invention.

As shown in FIG. 1, a prior art earth structure stabilizer 10, of generally annular form, has a longitudinal slot 12 to facilitate its circumferential compression—and insertion into an undersized bore (in an earth structure). The stabilizer 10 has a material thickness "X" which is prescribed due to the length of the stabilizer, and the forces necessary to effect its bore insertion. Because of the aforesaid thickness, then, and in the light of typically used and available insertion apparatus, the stabilizer 10 has a practical minimum diameter to which it can reasonably be compressed. Resultantly, the stabilizer 10 cannot be installed in bores of significantly smaller diameter than the aforesaid minimum.

FIGS. 2 and 3 depict an embodiment of an earth structure stabilizer 14, according to the invention, which is also of generally annular form and which also has a same longitudinal slot 12. However, as a comparison of FIG. 3 with FIG. 1 will evidence, stabilizer 14 has a significantly reduced material thickness "Y". Without more, the stabilizer 14 would lack sufficient longitudinal stiffness or strength to withstand bore insertion. Accordingly, it is a teaching of my invention to define the stabilizer 14 with elongate, axial stiffeners or ribs 16.

The ribs 16 project inwardly, in order that they will not interfere with the outer surface/bore wall frictional interface. Also, each rib occupies but approximately twelve and a half degrees of arc. Therefore, the preponderence of the outer surface 18 is available for said frictional interface.

The ribs 16 are generally arcuate in cross-section and, consequently, define elongate, axial coves or channels 20 in the outer surface 18. Now, whereas the ribs 16 comprise stringers or stiffeners which enhance the longitudinal strength of the stabilizer 14, the channels 20 reduce the circumferential strength thereof in the FIG. 4 embodiment, and in the FIG. 3 embodiment upon the slot 12 closing. The circumferential strength is reduced also because the gage or thickness "Y" is less than standard. Further, for any given segment of the stabilizer 14, the material, in a circumferential direction, is greater than the area encompassed by the segment (due to the channel(s) 20). Accordingly, the effective length of material, subjected to circumferential compression, is greater and, accordingly exhibits a greater response to such compression. Illustratively, the difference is like that proceeding from bending a first piece of spring steel, of a given gage, and of a given length, with a prescribed force, and bending a second piece of the same spring steel, of the same given gage, but of twice the given length, with the same prescribed force. The first steel piece will be stiffer, i.e., less compliant, than the second piece. The channels 20 effectively increase the "length" of the stabilizer in the circumferential direction and, thus, render it more compliant. Accordingly, stabilizer 14 can withstand insertion forces equally as well as the prior art stabilizer 10 (FIG. 1), but it can be circumferentially compressed to significantly smaller diameters than the prior art stabilizer.

Much of the stiffening strength of the ribs 16 proceeds from the arcuate form and tight radius thereof, and from the substantially abrupt deformation thereof from the outside surface 18. Each channel 20 has a wall surface 22 which forms a substantially right-angular juncture with a tangent of the outside surface 18 most adjacent thereto; this is depicted in FIG. 3, by means of the angle "A".

Four ribs 16/channels 20 are shown but, of course more or less may be employed as desired. Also, the stabilizer does not necessarily need to have a slot 12. Fig. 4 depicts an alternative embodiment 14*a* of the inventive stabilizer in which there is no slot. It has the ribs 16/channels 20 however, and is of like gauge or thickness "Y".

While I have described my invention in connection with specific embodiments thereof, it is to be clearly understood that this is done only by way of example and not as a limitation to the scope of my invention as set forth in the objects thereof and in the appended claims.

I claim:

1. An improved earth structure stabilizer, for insertion into a bore formed in an earth structure such as a roof or side wall of a mine shaft, or tunnel, or a like subterranean opening, for frictionally stabilizing such earth structure, said stabilizer comprising an elongate element having a length taken from, and comprised by, a range of lengths of from two and a half feet to six or more feet, and having a generally annular cross-section of a given, free, and single outside diameter, and formed of material of one uniform thickness, responsive to circumferential compression to facilitate a diminution of said given diameter to another, compressed, outside diameter, whereby said stabilizer can be inserted into and received by an earth structure bore having a diameter generally approximating said another diameter, to cause said stabilizer to engage the surface of such bore and frictionally anchor therewith, to stabilize the earth structure in which such stabilizer-receiving bore is formed, wherein the improvement comprises:

stiffener means, of substantially uniform dimension and conformation, extending lengthwise of said element, and projecting radially inwardly thereof only, for stiffening said stabilizer elongatedly; wherein said stiffener means comprises means for diminishing compression resistance of said element circumferentially thereof;

said resistance-diminishing means comprises a plurality of circumferentially and substantially uniformly spaced-apart channels formed in the outside surface of said element and extending lengthwise thereof; and each of said channels includes side wall which are spaced apart to define an open cove or recess, in said outside surface, the radially outermost area of which occupies approximately between five and six degrees of arc, said coves or recesses defining means for permitting said stabilizer to be circumferentially compressed in order that it may fit into a smaller earth bore.

2. An improved earth structure stabilizer, according to claim 1, wherein:

said stiffener means comprises a plurality of circumferentially spaced-apart ribs formed on the inside surface of said element and extending lengthwise thereof.

3. An improved earth structure stabilizer, according to claim 1, wherein:

each of said channels has a wall surface which defines a substantially right-angular juncture with said outside surface.

4. An improved earth structure stabilizer, according to claim 1, wherein:

each of said channels is circumferentially spaced, from a channel circumferentially adjacent thereto, a common, given distance.

5. An improved earth structure stabilizer, according to claim 2, wherein:

each of said ribs is circumferentially spaced, from a rib circumferentially adjacent thereto, a common, given distance.

6. An improved earth structure stabilizer, according to claim 2, wherein:

said ribs are substantially arcuate in cross-section.

7. An improved earth structure stabilizer, according to claim 2, wherein:

said ribs occupy not more than approximately one-eighth of said inside surface.

8. An improved earth structure stabilizer, according to claim 2, wherein:

each of said ribs subsists diametrically opposite another thereof.

9. An improved earth structure stabilizer, according to claim 1, wherein:

each of said channels subsists in said outside surface diametrically across from another thereof.

* * * * *